United States Patent [19]

Deforeit

[11] Patent Number: 4,520,706

[45] Date of Patent: Jun. 4, 1985

[54] ELECTRONIC MUSICAL INSTRUMENT

[75] Inventor: Christian J. Deforeit, Semur-en-Auxois, France

[73] Assignee: Matth. Hohner AG, Trossingen, Fed. Rep. of Germany

[21] Appl. No.: 569,579

[22] Filed: Jan. 10, 1984

[30] Foreign Application Priority Data

Jan. 18, 1983 [DE] Fed. Rep. of Germany ..... 3301354

[51] Int. Cl.[3] ..... G10H 3/00

[52] U.S. Cl. ..... 84/1.1; 84/1.24; 84/DIG. 7

[58] Field of Search ..... 84/1.1, 1.24, DIG. 7, 84/1.01, 1.19

[56] References Cited

U.S. PATENT DOCUMENTS

| | | | |
|---|---|---|---|
| 4,079,651 | 3/1978 | Matsui | 84/1.1 |
| 4,111,092 | 9/1978 | Adachi | 84/1.24 |
| 4,213,367 | 7/1980 | Moog | 84/1.1 |
| 4,268,815 | 5/1981 | Eventoff | 84/DIG. 7 |

*Primary Examiner*—Forester W. Isen

[57] ABSTRACT

The touch dynamics of the operation of keys of an electronic musical instrument are determined through the use of pressure sensitive transducers associated with the keys, the transducers providing signals which are analyzed to determine their variation in magnitude as a function of time. Additionally, after a preselected time period, if a key remains operated and the pressure exerted thereon is varied, the output voltage of the key associated transducer will be further analyzed to determine if the player is calling for the reproduction of a secondary effect.

10 Claims, 12 Drawing Figures

ELECTRONIC MUSICAL INSTRUMENT

BACKGROUND OF THE INVENTION (1) Field of the Invention

The present invention relates to electronic musical instruments and particularly to improvements in keyboard instruments such as electronic organs. More specifically, this invention is directed to enhancing the quality of sound produced by keyboard-type electronic musical instruments and especially to the generation of signals having electrical characteristics commensurate wth the manner in which the keys are operated. Accordingly, the general objects of the present invention are to provide novel and improved apparatus and methods of such character.

(2) Description of the Prior Art

While not limited thereto in its utility, the present invention is particularly well-suited for incorporation in that type of keyboard instrument generally called an "electronic organ". An electronic organ produces audible sound in response to the depression of keys on a keyboard or keyboards. The operation, i.e., the depression, of a key by the player of a prior art electronic organs typically causes the operation of a switch. A switch, however, can only indicate whether or not the associated key has been touched. Since an electronic organ optimally is selectively employed to simulate various instruments, the simple detection of a switch closure does not provide sufficient information to enable the production of a complex command signal which may be transduced into the tone desired by the player. For example, in the playing of a piano the sound which wll be produced will be a function of how the key is depressed by the player, i.e., harder or softer. Thus, the typical prior art electronic organ could not simulate a piano with a high degree of realism.

In order to overcome the above-discussed problem it has been proposed to attempt to measure the time required for a key stroke and produce an output signal commensurate with the measured time. This approach is based upon the incorrect assumption that if the measured time is "short" there has necessarily been a "hard" touch while a "long" measured time is indicative of a "soft" key operation.

It is also to be noted that in the playing of various types of musical instruments, string instruments for example, the player will produce desired effects by means of the movements of his fingers while a note is being sounded. The well-known vibrato effect is but one example of a sound quality produced by finger movement during the production of a tone. Previously available electronic keyboard instruments have not been able to successfully simulate "secondary effects" such as vibrato.

SUMMARY OF THE INVENTION

The present invention overcomes the above-discussed and other deficiencies and disadvantages of the prior art by providing for the detection and subsequent generation of signals commensurate with the touch dynamics of the keys of a keyboard-type electronic musical instrument. Apparatus in accordance with the present invention, when added to an electronic musical instrument, permits the simulation of sound commensurate with the dynamics of the key touch and, in a preferred embodiment, also permits simulation of secondary effects such as vibrato.

In accordance with a preferred embodiment, wherein the present invention is employed in an electronic musical instrument having at least one keyboard through which the sounds to be produced are selected, each key is associated with a pressure sensitive transducer such as a resistance which is variable as a function of the pressure exerted on the key during its operation. The resistance variation is analyzed as a function of time to provide an output signal which is indicative of how hard the key has been struck. Thus, in the preferred embodiment, the slope of the voltage drop across the variable resistance will be employed as a measure of the forcefulness with which the associated key has been touched. Also in accordance with the preferred embodiment, the measurement of the rate of change of the voltage across the variable resistance will be delayed in the interest of avoiding the generation of undesired sound.

The preferred embodiment of the present invention, in the interest of generating "secondary effects", also compares the difference in the signal generated by the pressure sensitive transducer, for example the voltage dropped across the variable resistance associated with a particular key, at spaced instance in time to determine whether the player is continuing to operate the key but desires to modulate the tone produced by moving his playing finger.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE DISCLOSED EMBODIMENT

Figure 1:
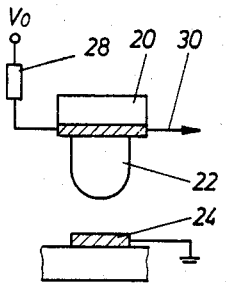
FIGS. 1–3 schematically represent a first embodiment of a pressure-sensitive signal transducer which may be employed in the present invention, the FIGURES representing the transducer with the associated key in different states of actuation.
Figure 2:
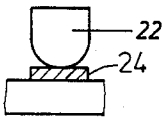
Figure 3:
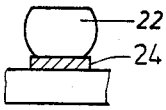

With reference now to the drawing, pressure sensitive transducers which may be associated with the individual keys of a keyboard-type electronic musical instrument are shown schematically in FIGS. 1–9. In FIG. 1 a block of elastomeric polymer material which includes an electrically conductive additive is indicated at 22. Because of the conductive additive, the polymer element 22 will have a pre-selected degree of conductivity. As will be described in more detail below, the conductivity between two spaced points on the surface of the polymer element 22 will increase as the material is compressed. In the embodiment of FIGS. 1–3, as shown in FIG. 1, the polymer element 22 is attached to a key 20 of the instrument by means of a conductive pad. The lower end of the polymer element 22 is contoured, i.e., rounded, and when the key 20 is operated the rounded end of element 22 will be brought into contact with a conductive trace 24 on a printed circuit board 26 which forms part of the keyboard assembly of the instrument. The conductive trace 24 is electrically grounded while the polymer element 22 is connected to a voltage source Va via the conductive pad and a fixed resistor 28. Accordingly, when the key 20 is operated the fixed resistor 28 and polymer element 22 will define a voltage divider having an output terminal 30. The voltage dropped across polymer element 22 may be measured at terminal 30.

FIG. 1 depicts the key in the unactuated condition, i.e., before it is touched by the player. At this time, with no current flow through the voltage divider circuit, voltage Va will appear at terminal 30. When the key is touched the rounded end of polymer element 22 will come into contact with pad 24 as depicted in FIG. 2. The harder the key is pressed the more the element 22 will be compressed and, correspondingly, the contact area between element 22 and pad 24 will be increased. Accordingly, the greater the pressure exerted on key 20 the smaller will be the resistance of element 22 and the lower the voltage measured at terminal 30.

Figure 4:
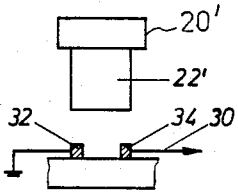
FIGS. 4–6 are views similar to FIGS. 1–3 which schematically depict a second embodiment of a pressure-sensitive transducer for use with the present invention.
Figure 5:
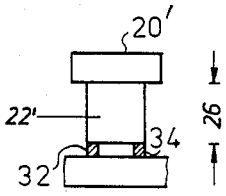
Figure 6:
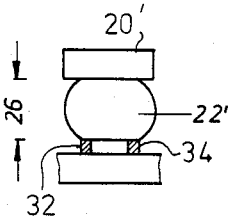

The embodiment of FIGS. 4–6 differs from that of FIGS. 1–3 in that the polymer element 22' is not contoured at its lower end and is connected directly to the key 20'. Additionally, in the embodiment of FIGS. 4–6 the single conductive pad on the printed circuit board beneath each key is replaced by a pair of spaced contact strips 32, 34. Contact strip 32 is connected directly to ground in the disclosed embodiment. When the key is depressed the polymer element 22' will bridge contact strips 32 and 34. As the pressure on the key is increased the degree of compression of element 22' will be increased and its height, represented at 26, will be decreased. The resistance between contact strips 32 and 34 will be a function of the degree of compression of element 22' and thus the voltage at terminal 30, as in the embodiment of FIGS. 1–3, will be a measure of the force exerted on the key.

Figure 7:
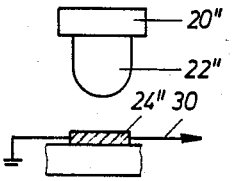
FIGS. 7–9 are views similar to FIGS. 1–3 which schematically represent a third embodiment of a transducer for use in the practice of the present invention.
Figure 8:
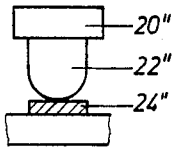
Figure 9:
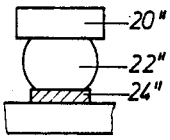

In the embodiment of FIGS. 7–9 the key 20'' carries a resilient block 22'' comprised of a material having good electrical conductivity. The free end of element 22'' is rounded. The resilient conductive element 22'' cooperates with a resistive element 24'' carried by the circuit board which underlies the key 20''. When the key 20'' is depressed the element 22'' will be caused to contact resistance element 24'', as shown in FIG. 8, and the area of surface contact between element 22'' and resistive element 24'' will increase as a direct function of applied pressure. Accordingly, resistor 24'' will be partially short-circuited by element 22'' and the amount of resistance which will be removed from the circuit will be a function of the force applied to the key 20''. Thus, as in the embodiments of FIGS. 1–3 and FIGS. 4–6, the transducer embodiment of FIGS. 7–9 functions as a variable resistance with a voltage commensurate with applied pressure appearing at an output terminal 30. Also, because of the resiliency of the elements 22, 22' and 22'', a modulated output voltage may be produced by varying the force applied to a depressed key.

It is to be observed that any desired voltage versus key pressure relationship can be obtained by variation of parameters such as the shape and hardness of the elements 22, 22' and 22'', variation of the physical and/or electrical characteristics of the resistance element 24'' of the embodiment of FIGS. 7–9 and by other measures.

Figure 10:
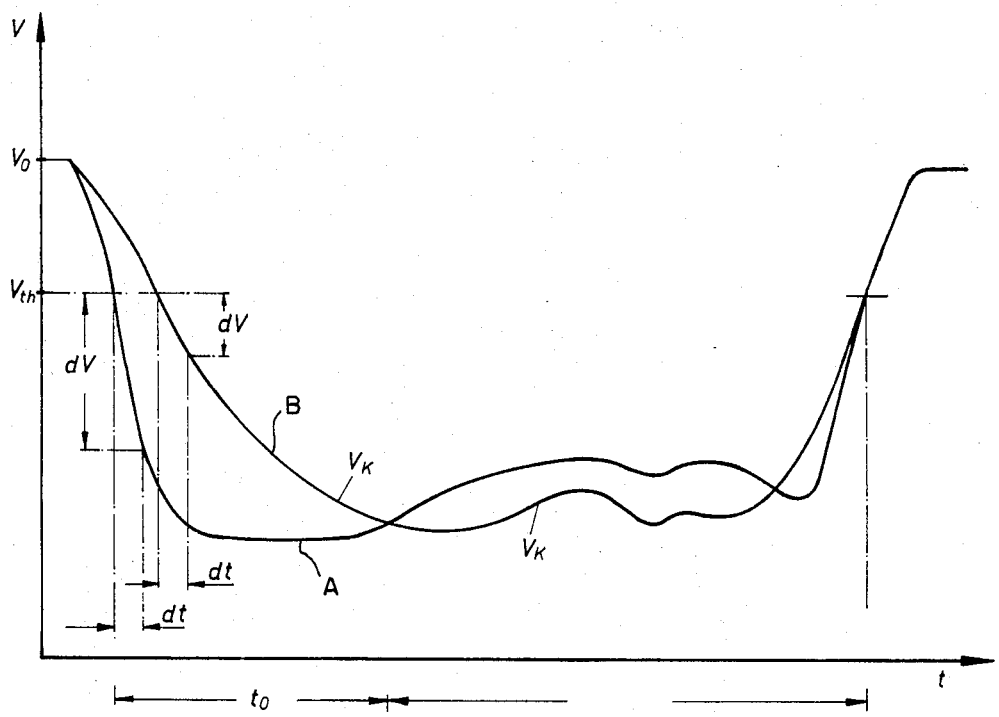
FIG. 10 is a representative voltage/time characteristic curve which would be generated employing one of the transducers of FIGS. 1–9.

FIG. 10 graphically depicts a typical output voltage $V_{30}$, which could be produced by one of the embodiments of FIGS. 1–9, as a function of time. In FIG. 10 curve A represents a forceful key touch while curve B represents a softer touch. As will be described in greater detail below in the discussion of FIG. 11, the voltage $V_{30}$ is processed as soon as it drops below a pre-selected threshold voltage $V_{th}$. The desired information regarding the touch dynamics, i.e., the manner in which the key has been actuated by the player, may be obtained by calculating the slope of the voltage curve, by determining the time interval during which a pre-determined decrease in voltage has occurred or by determining the voltage drop dV which occurs during a given time interval dt after the voltage $V_{30}$ has dropped below the threshold voltage $V_{th}$. In the disclosed embodiment of the present invention the latter technique is employed. Additionally, after elapse of a pre-determined time $t_o$, for example 50 msc, it can be assumed that even a very soft key touch has been completed. The player can now cause the simulation of secondary effects such as vibrato by varying key pressure. The changes in the voltage $V_{30}$ after period $t_o$ has elapsed must therefore be processed in a different manner than the initial touch dynamics information, i.e., the force of the original stroke, and as a function of which secondary effect the player wishes to produce. If the voltage $V_{30}$ rises above the level $V_{th}$ it is assumed that the key has been released.

In summary, in order to produce a signal commensurate with the dynamics of the key stroke and any secondary effects desired by the player, the circuitry associated with the transducer embodiments of FIGS. 1–9 must fulfill the following functions for each key:

(1) Determination of whether $V_{30}$ has dropped below $V_{th}$,
(2) Determination of dV/dt,
(3) Determination of the passage of time $t_o$,
(4) Determination of changes in voltage $V_{30}$ after time $t_o$, and
(5) Determination of when $V_{30}$ returns to a level greater than $V_{th}$.

Figure 11:
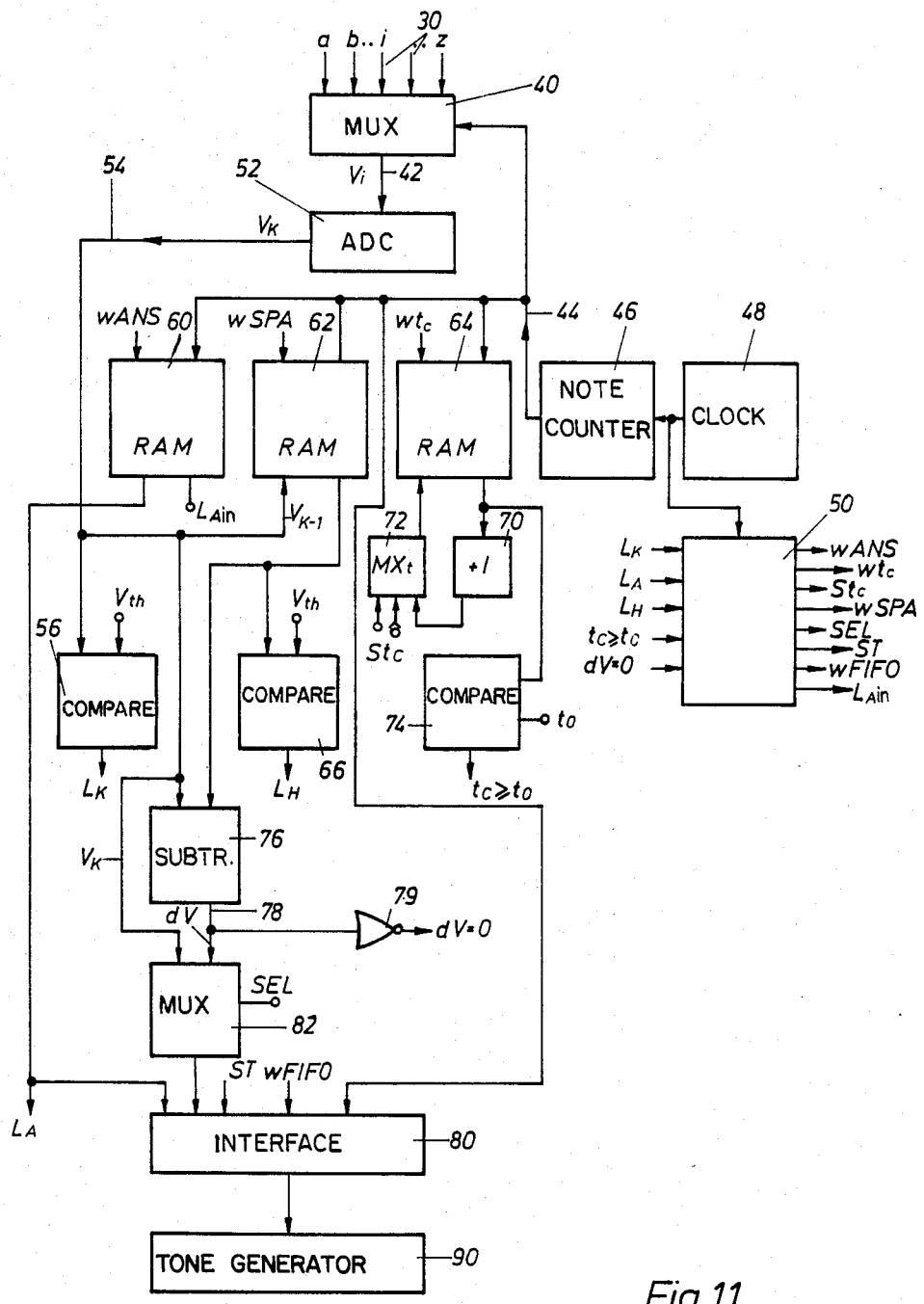
FIG. 11 is a functional block diagram of a first embodiment of signal generation circuitry for use in association with the transducers of FIGS. 1–9.
Figure 12:
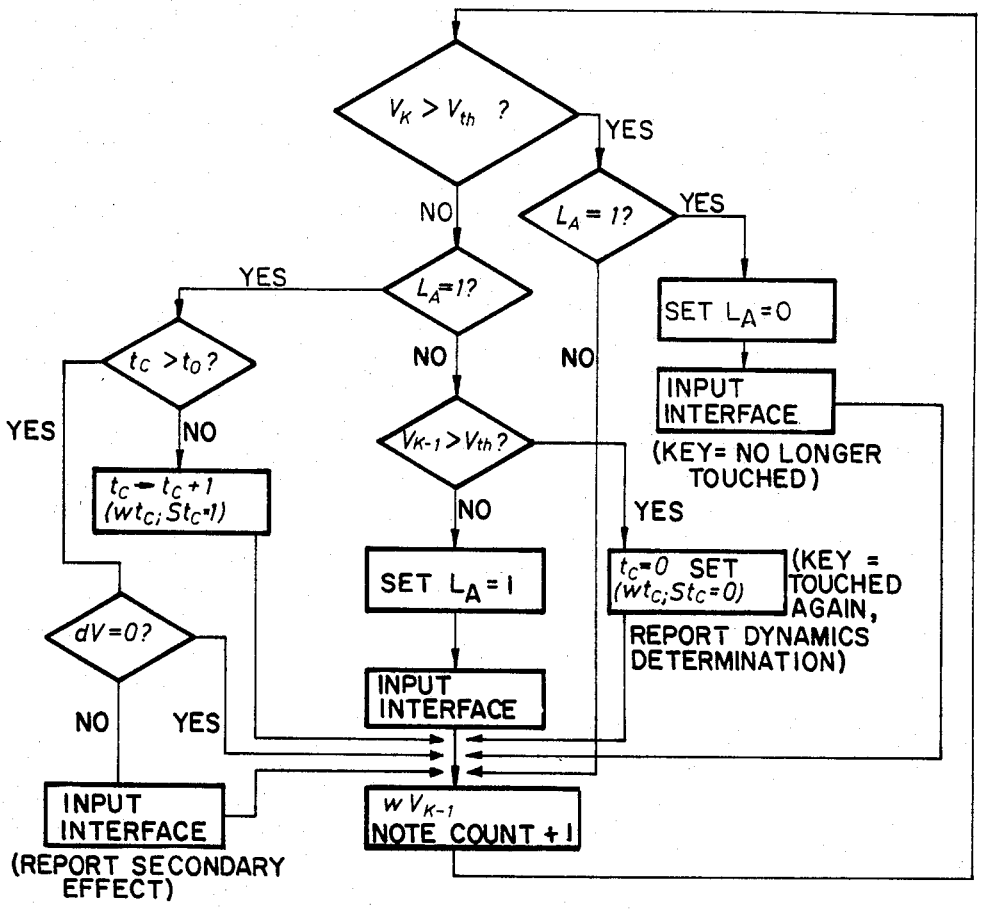
FIG. 12 is a data flow diagram which represents and explains the operation of the circuit of FIG. 11.

Referring simultaneously to FIGS. 11 and 12, circuitry for accomplishing the above-enumerated functions will now be described. The analog signals, i.e. the voltages $V_{30}$a, b,—i—z, from the individual key associated transducers are converted into serial data in a multiplexer circuit 40. This serial data, which is present at the output 42 of multiplexer 40, is delivered to an analog-to-digital convertor 52. The timing of multiplexer 40 is controlled, via conductor 44, by the output of a note counter 46 which, in turn, is controlled by a clock generator 48. The clock generator 48 also clocks a logic circuit 50 which performs the functions to be discussed below.

Analog-to-digital convertor 52 converts the input voltages $V_i$ serially delivered thereto to corresponding digital signals $V_k$. The digital data $V_k$ is supplied as a first input to a comparator 56 and as inputs to a random access memory 62, a subtraction circuit 76 and a multiplexer 82. The second input to comparator 56 is a digital signal which corresponds to the threshold voltage $V_{th}$.

Comparator 56, accordingly, provides output logic levels $L_k$ which are indicative of whether the voltages $V_i$, indicative of the states of operation of the serially scanned keyboard circuit transducers, have dropped below the threshold level.

The circuit of FIG. 11 includes three random access memories 60, 62 and 64. These three RAM's will each have at least as many storage locations as there are inputs to the multiplexer circuit 40. Accordingly, each key contact will have an addressable storage location in each RAM. In the cycling of multiplexer 40, data commensurate with the operation of each key will be stored at its unique memory location. Memory 60, i.e., the "touch memory", will hold data commensurate with the touch condition of the keys. Memory 62 will hold the current values of the voltages $V_k$ and thus may be referred to as the "voltage memory". Memory 64 is the "time memory" which stores the current value of time. The three RAM's are addressed by note counter 46 in synchronism with the timing of the multiplexer circuit 40.

The logic level $L_k$ which appears at the output of comparator 56 functions as one of the control inputs to logic circuit 50. The logic level $L_k$ will indicate key state, i.e., that a key has just been deliberately operated or that the key had already been operated during the previous cycle of the multiplexer. The appearance of the logic level $L_k$ commensurate with key operation at the output of comparator 56 will cause logic circuit 50 to generate a $L_{Ain}$ command which causes read-out of the coordinates of the corresponding storage location in "touch" memory 60 and a touch status logic level $L_A$. The $L_A$ information read out of RAM 60 is delivered as an input to logic circuit 50 and also comprises input information for the tone generation circuits of the instrument.

In order to determine if the respective key was already depressed when logic level $L_k$ is outputted by comparator 56 during sequencing, the $V_k$ data generated during the previous multiplex cycle will be compared with the threshold level $V_{th}$ in a second comparator 66. Since the value $V_k$ delivered to comparator 66 will have been stored in RAM 62 during the previous multiplex cycle this data may be referred to as the level $V_{k-1}$. The comparator 66 will provide a logic level $L_H$, which is delivered as an input to logic circuit 50, when $V_{k-1}$ is less than $V_{th}$. The receipt of signal $L_H$ will cause logic circuit 50 to deliver a "write" command wANS to "touch" memory 60. The memory 60 will thus store, at each memory location, $L_A$ information in the form of a logic "1" or "0" commensurate with whether or not the corresponding keys had been in the actuated condition during the preceeding multiplex cycle.

If the $L_A$ signal outputted from memory 60 is at a logic level indicative of a first pressing of the key, two events will be triggered. Firstly, the time interval $t_o$ will be measured. Secondly, the touch dynamics will be determined.

For the first event, i.e., the measurement of interval $t_o$, the appropriate storage location in "time" memory 64 is set to zero by command Stc from logic circuit 50. The stored value is read-out, incremented by one unit through the use of an addition circuit 70 and the incremented value is written into memory 64 via multiplexer circuit 72. This procedure will continue until the current time value $t_c$ is equal to the pre-determined interval $t_o$. The current time value $t_c$ stored in RAM 64 is compared with a signal commensurate with the pre-determined interval $t_o$ in a comparator 74. The output logic level of comparator 74 is fed back as a control signal to logic circuit 50 since, subsequent to the time when $t_c$ equals $t_o$, the voltage data $V_k$ must be analyzed in a manner commensurate with the desired secondary effect. The logic circuit 50 also generates an appropriate command ST which enables the time measuring process to be recognized as finished for the particular key.

Logic circuit 50 will generate the command wSPA when t is greater than one multiplexer cycle and $L_A$ indicator that the corresponding key had previously been actuated. Upon delivery of the wSPA command to RAM 62, the stored $V_{K-1}$ data will be read out to a subtraction circuit 76. The current voltage value $V_k$ is subtracted from value $V_{k-1}$ in subtraction circuit 76. Accordingly, data commensurate with the voltage difference dV will appear at the output 78 of subtraction circuit 76. The associated time interval is the time necessary to complete one multiplex cycle. Obviously, if the value dV is zero there is no voltage difference to analyze. All bits of the calculated dV value are inputted to a gate 79 which provides, as its output signal, a logic level indicative of all bits showing a voltage difference of zero. If all bits of dV are not zero and tc is greater than $t_o$, a "secondary effect commanded" signal will be generated.

The touch dynamics will be determined, by circuitry which does not comprise part of the present invention, from the dV signal provided at the output of subtraction circuit 76 when the output of gate 79 is not "zero". The touch dynamics information bearing signal is commensurate with the decrease in the voltage $V_{30}$ occurring during the first multiplex cycle time $t_o$ occurring subsequent to the generation of the $L_k$ signal by comparator 56.

As soon as the touch dynamics have been determined from the value dV, this value can be continued to be used as information from which the desired secondary effect will be determined. Alternatively, the actual signal level $V_k$ may be employed for determination of whether the player is calling for a secondary effect. Accordingly, the output of convertor 52 and the output of subtraction circut 76 are provided as inputs to a multiplexer 82 which functions as a data selection circuit under the command of an SEL signal provided by logic circuit 50. The output signal passed through selection multiplexer 82 is delivered as one of the inputs to an output interface 80. Interface 80 additionally receives the $L_A$ signal from RAM 60, the ST status signal from logic circuit 50, the output of note counter 46 and a wFIFO control signal, which will be discussed below, which is also provided by logic circuit 50. The interface 80 is informed, by means of the status signal ST, whether the signal inputted thereto via selection multiplexer 82 constitutes the measurement of touch dynamics, i.e., $t_o$ not yet elapsed, or of the secondary effect.

The interface 80 is constructed as shift register from which the input data can be read out asychronously with the clock from clock generator 48. The information read from interface 80 is delivered to tone generating circuits 90 of the instrument. The outputs of note counter 46 and "touch" memory 60 will serve to identify the key which is associated with the other data simultaneously delivered to the tone-generating circuits. Data is read into the shift register comprising interface 80 by means of the wFIFO command from logic circuit 50. The shift register, i.e., interface 80, will be a device in which the first inputted data will also be the first data to be read out, i.e., device 80 will be a "FIFO register".

Logic circuit 50 may be comprised of a read-only memory or a system of gates. Those skilled in the art, through reference to FIG. 12, could program a read-only memory to function as logic circuit 50. The entire circuit depicted in FIG. 11, with the exception of multiplexer 40, can take the form of a microprocessor such as, for example, INTEL type 8020.

When a previously touched key is released the output levels of comparators 56 and 66 will automatically and serially change.

The circuit of FIG. 11 will operate in a manner which will be obvious to those of ordinary skill in the art by simultaneous reference to the flow diagram of FIG. 12 and the functional circuit block diagram of FIG. 11.

It is to be understood that the present invention is not limited to the embodiment described and shown herein, which is deemed to be merely illustrative of the best mode of carrying out the invention, and which is susceptible of modification of form, size, arrangement of parts and details of operation. The invention rather is intended to encompass all such modifications which are within its spirit and scope as defined by the claims.

What is claimed is:

1. In an electronic musical instrument, the instrument having at least a first keyboard with movable keys for selecting the sounds to be produced, the instrument further having tone generating circuitry responsive to signals produced by operation of the keys for providing signals which may be transduced into the selected sounds, the improvement comprising:

transducer means associated with each key, an electrical characteristic of said transducer means varying as a function of the pressure exerted on the associated key, said transducer means each having an output terminal;

electrical power supply means connected to said transducer means whereby voltages which vary as a function of the pressure exerted on the keys will be generated and will appear at said transducer means output terminals;

clock means for generating timing signals;

multiplexer means, said multiplexer means serially and cyclically sampling the voltages which appear at said transducer means output terminals and individually passing the sampled voltages;

means for converting the voltages passed by said multiplexer means into digital data commensurate therewith;

first comparator means for comparing digital data commensurate with the voltages appearing at each of said transducer means output terminals during two successive cycles of said multiplexer means, said first comparator means generating signals commensurate with the difference between the said each transducer means output terminal voltages;

means generating a signal commensurate with a threshold level of key pressure;

second comparator means for comparing said digital data from said converting means with said signal commensurate with the threshold pressure level and generating control signals indicative of the achievement of equality therebetween; and means responsive to said control signals, said timing signals, said digital data commensurate with said transducer means output terminal voltages and the signals generated by said first comparator means for producing input signals for the tone generating circuitry of the instrument, said input signals being commensurate with variation with time of each of said transducer means output terminal voltages subsequent to said output terminal voltages having reached values commensurate with the said threshold pressure level.

2. The apparatus of claim 1 wherein said transducer means each comprises:

a resistance which is variable as a function of the pressure exerted on the associated key, said resistance being connected to said power supply means.

3. The apparatus of claim 2 wherein the resistance values of said transducer means decrease as a function of exerted pressure and wherein said means for producing tone generating circuitry input signals comprises:

means for determining the rate of any change of said transducer means output terminal voltages during the exertion of pressure on the keys and providing signals commensurate therewith, said rate of change signals being a measure of the forcefulness with which the associated keys are being touched.

4. The apparatus of claim 1 further comprising:

means providing a command signal a predetermined time subsequent to the generation of a control signal by said second comparator means; and means responsive to said command signals and to said signals commensurate with said transducer means output terminal voltage for providing signals indicative of the continued exertion of pressure on an operated key, variation of said signals commensurate with a continued exertion of pressure on corresponding keys generating a secondary tonal effect.

5. The apparatus of claim 1 wherein said first comparator means includes:

first memory means for storing the digital data provided by said converting means, said first memory means having a storage location for each key.

6. The apparatus of claim 5 wherein said means for producing tone generating circuitry input signals further includes:

means providing command signals a predetermined time subsequent to the generation of a control signal by said second comparator means; and means responsive to said command signals for providing an indication that the signals generated by said first comparator means are indicative of the desire to create a secondary tonal effect.

7. In an electronic musical instrument, the instrument having at least a first keyboard with movably keys for selecting the sounds to be reproduced, the instrument further having tone generating circuitry responsive to signals produced by operation of the keys for providing signals which may be transduced into the selected sounds, the improvement comprising:

pressure sensitive transducer means associate with each key, said transducer means providing output signals which are variable as a function of the pressure exerted on the associated key, said transducer means each having an output terminal;

electrical power supply means connected to said transducer means whereby voltages which vary as a function of the pressure exerted on the keys will be generated and will appear at said transducer means output terminals;

clock means for generating timing signals;

multiplexer means, said multiplexer means serially and cyclically sampling the voltages which appear at said transducer means output terminals and providing output signals commensurate with the sampled voltages;

means establishing a threshold key exertion pressure level and generating a signal commensurate therewith;

first comparator means for comparing said signal commensurate with threshold pressure level with the signals provided by said multiplexer means, said first comparator generating enabling signals when the compared signals achieve equality;

first memory means for storing at separate memory locations the signals serially provided by said multiplexer means;

second comparator means responsive to the enabling signals generated by said first comparator means, said second comparator means being coupled to said first memory means and said multiplexer means and comparing the signals serially provided by said multiplexer means with signals stored in said first memory means during the sampling the corresponding transducer means during the previous multiplexer means cycle, said second comparator means generating output signals commensurate with the difference between the compared signals, said difference output signals being indicative of the forcefulness with which the associated keys have been touched; and means for applying said difference output signals to the instrument tone generating circuitry.

8. The apparatus of claim 7 wherein said second comparator means includes:

means for converting the voltages passed by said multiplexer means into digital data.

9. The apparatus of claim 7 further comprising:

means providing a command signal a predetermined time subsequent to the generation of an enabling signal by said first comparator means; and means responsive to the generation of a command signal for continuing the operation of said second comparator means and for indicating that any variation in said difference output signals corresponds to a desired secondary effect.

10. The apparatus of claim 7 wherein said transducer means each comprises:

a variable resistance.

* * * * *